US007955128B2

(12) United States Patent
Shultz et al.

(10) Patent No.: US 7,955,128 B2
(45) Date of Patent: Jun. 7, 2011

(54) ELECTRICAL POWER SYSTEM, METHOD AND ASSEMBLY HAVING NONCONDUCTIVE SUPPORT BAR

(76) Inventors: Preston Shultz, Woodstock, CT (US); Kevin Crowl, Upper Jay, NY (US)

( * ) Notice: Subject to any disclaimer, the term of this patent is extended or adjusted under 35 U.S.C. 154(b) by 0 days.

(21) Appl. No.: 12/609,441

(22) Filed: Oct. 30, 2009

(65) Prior Publication Data

US 2011/0101805 A1 May 5, 2011

(51) Int. Cl.
*H01R 13/58* (2006.01)

(52) U.S. Cl. ..... 439/606

(58) Field of Classification Search ..... 439/606, 439/651

See application file for complete search history.

(56) References Cited

U.S. PATENT DOCUMENTS

| | | | | |
|---|---|---|---|---|
| 3,358,267 | A | 12/1967 | Henderson | |
| 4,758,175 | A | 7/1988 | Didier et al. | |
| 5,941,718 | A | 8/1999 | Didier | |
| 6,832,925 | B2 | 12/2004 | Draggie et al. | |
| 2004/0038576 | A1 | 2/2004 | Draggie et al. | |
| 2006/0172583 | A1 * | 8/2006 | Duhe, Jr. | 439/359 |
| 2008/0238201 | A1 | 10/2008 | Oliver et al. | |

* cited by examiner

*Primary Examiner* — Javaid Nasri
(74) *Attorney, Agent, or Firm* — UConn IP Law Clinic; Lily Neff

(57) ABSTRACT

A method, system and assembly for transferring electrical power adapted to provide power to a grounded aircraft is provided. The assembly comprises a first and second insulated electrical conductor and a plug body, attached to ends of these conductors. A first contact and a second contact is provided within the plug body, having electrically conductive connections with the first and second conductors. A non conductive support bar disposed at least partially within the plug body separating at least portions of the first contact and the first conductor from the second contact and the second conductor.

20 Claims, 2 Drawing Sheets

400

ELECTRICAL POWER SYSTEM, METHOD AND ASSEMBLY HAVING NONCONDUCTIVE SUPPORT BAR

FIELD OF INVENTION

This invention relates generally to an assembly for transferring electrical power and more particularly to a plug assembly having a nonconductive support bar.

BACKGROUND OF THE INVENTION

A sizable fraction of ignitions of structures, resulting in serious fires, are due to electrical distribution problems. Every year, these electrical fires account for many deaths and injuries, and millions of dollars in direct property damage. The cause of many electrical distribution problems can be attributed to faulty wirings, cords and plugs. The malfunctioning of these components often lead to overheating or sudden generation of sparks that can potentially cause fires and even explosions. The source of such malfunctions can be varied, stemming from arcing, short circuits, poor connections or sudden rupturing and shearing of cables caused by tensile forces.

An electric arc can be defined as formation of a channel of hot ionized plasma gas that is highly conductive. This causes an electrical breakdown, resulting in a flow of current between contacts separated by small gaps, even in instances where they are separated by insulative coating or a nonconductive media such as air. An unintended electric arc or alternatively arc flash, can be particularly detrimental to electric power transmission and distribution systems. In addition, an electrical arc can result in very high temperatures that melts most material and poses serious threats of injury. Devices which may cause arcing include switches, circuit breakers, relay contacts, fuses and cables, especially cables with poor terminations.

Short circuits are caused when there is a surge of current in an unintended part of a circuit or a network. When an abnormally low resistance connection is created between two nodes that are meant to be kept at different voltages, charges flow quickly along this different and unintendedly formed path. The sudden flow of excessive electric current leads to overheating of the device and the surrounding areas, potentially causing fires and explosions. Short circuits are most likely to occur between conductors of two different phases, such as that of voltage/power phases and neutral/ground phases. It is, however, possible for short circuits to arise between two conductors of the same phase.

A number of conditions can cause an unintentional short circuit. Some examples are structurally damaged or bent metal components like prongs and socket contacts, stalled motors, and jammed pumps/fans caused by debris. Short circuits can also be caused by worn insulations, such as on wires, cables and other electrical components. For example, a worn wire insulation in a battery cell can expose the underlying metal and create a path between positive and negative terminals. The ensuing low resistance across this connection then causes a large amount of energy to be dispersed quickly. The rapid buildup of associated heat can lead to fires/explosions that can release hydrogen gas and electrolytes and/or cause chemical exposures to acids or base fluids.

In the airline industry, electrical fires are a source of major concern not just in the air, but more importantly on the ground. Aircraft ground power assemblies are required to deliver ground power to aircrafts when parked or when in hangers undergoing inspection and repair. Faulty electrical distribution in these assemblies can lead to disastrous results. Proximity to large amounts of highly combustible jet fuel creates an excessive risk of damage and injury to nearby structures and individuals. In airports located close to densely populated areas, contamination issues and potential for complete infrastructural collapse further exacerbates this risk.

In recent years, electrical fires have been more frequently caused by faulty cables/plugs and worn insulations. Shearing and rupturing of cables can cause sparks and short circuits. In addition, misalignment of contacts caused by prolongued use, overheating or sudden forces experienced during engagement and disengagement of devices can also lead to electrical malfunctions. Consequently, minimizing the risk of electrical shorts and other related conditions caused by faulty cables and plugs is desired, especially when such components are utilized in assemblies that supply ground power to aircrafts.

SUMMARY OF THE INVENTION

The shortcomings of the prior art are overcome and additional advantages are provided through the provision of a method and assembly for transferring electrical power. The assembly comprises a first and second insulated electrical conductor and a plug body attached to the ends of these conductors. A first contact and a second contact are provided within the plug body, having electrically conductive connections with the first and second conductors, respectively. A nonconductive support bar is disposed, at least partially, within the plug body and separating at least portions of the first contact and first conductor from the second contact and second conductor. In a preferred embodiment, the plug body can also include a third contact with a regulatory mechanism for maintaining voltage input.

In an alternate embodiment, an aircraft power generation system adapted to provide power to a grounded aircraft is provided. The system comprises a generator and a cable assembly for transferring power from the generator to the aircraft. The cable assembly includes an insulated power conductor and an insulated ground conductor attached to a plug for connection to the aircraft. The plug includes a plug body having a nonconductor exterior with a proximal end proximate the aircraft and a distal end remote therefrom. The plug body also includes a power contact and a ground contact and a substantially rigid nonconductive element disposed between the conductors and the contacts. The substantially rigid element extends in a direction between the proximal and distal ends and is adapted to inhibit misalignment of the contacts and shearing and rupturing of the conductors.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION

Figure 1:
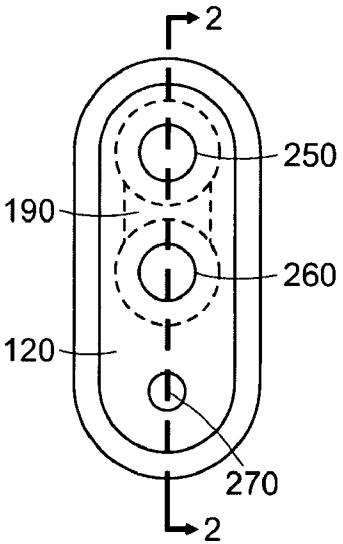
FIG. 1 is a side view illustration of an assembly for transferring electrical power, as per one embodiment of the present invention.
Figure 2:
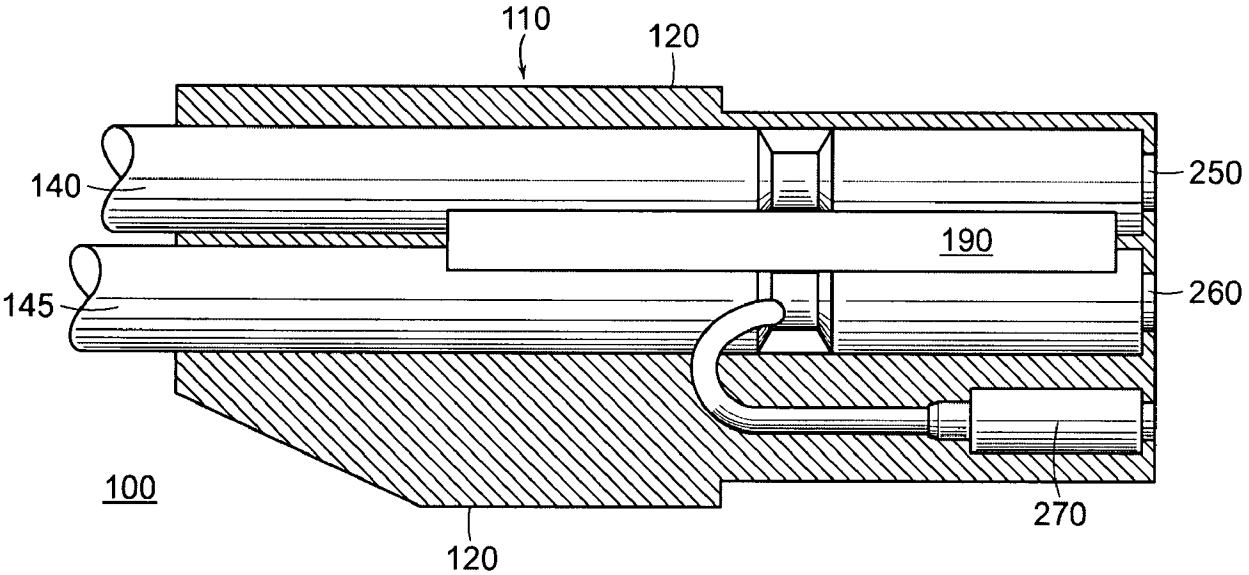
FIG. 2 is a cross sectional illustration of the embodiment of FIG. 1, cut across line A-A.

In accordance with embodiments of the invention described herein, FIG. 1 provides a side view illustration of an assembly 100 for transferring electrical power, as per one embodiment of the present invention. FIG. 2 is a cross sectional illustration of the embodiment of FIG. 1 cut across line A-A. FIGS. 1 and 2 provide different views of the assembly 100 and will be discussed together for ease of understanding.

The assembly 100 comprises plug 110 and a plurality of electrical conductors. In the depiction of FIG. 2, by way of example, a first and a second insulated electrical conductor 140 and 145 are provided. The electrical conductors 140/145 can include wiring, cables or other similar components as known to those skilled in the art. In the preferred embodiment shown, the electrical components 140/145 are insulated cables. The electrical conductors preferably are used to deliver voltage of the different phases, such as ground and power, but can be selectively used to deliver voltage of same phases as desired.

The plug 110 has a plug body 120 that is attached, by means known to those skilled in the art, to the electrical conductors 140 and 145. In a preferred embodiment, the plug body 120 is molded to the end of the electrical conductors 140 and 145 in order to provide a secure fit. The plug body 120 can be fabricated out of plastics and/or rubber such as to enable easy engagement and disengagement of the plug 110.

The plug 110 also includes a plurality of contacts. In a preferred embodiment, a plurality of socket contacts referenced as first and second contact 250 and 260 is provided. The socket contacts are electrically connected to electrical conductors 140/145. It should be noted that the electrical conductors 140 and 145 are at least partially enclosed in the plug body 120, although this is not a requirement. As long as the electrical conductors 140/145 are in electrical contact with the socket contacts 250 and 260, these conductors can be disposed entirely outside of the plug 110 if desired.

In one embodiment, the electrical conductors 140/145 can be manufactured separately than the plug. In this embodiment, the plug will include one or more attachment components for the electrical conductors to become attached or connected to the plug and/or to become in contact with the socket contacts 250 and 260.

In one embodiment of the present invention, the contacts 250 and 260 have opposite charges and can be further identified as negative and positive, power and ground or by other such similar designations. In a preferred embodiment, a third contact 270 is also provided having a regulatory mechanism for maintaining voltage input. This is to prevent a sudden surge of current that can lead to overheating and/or electrical sparks to maintain required voltage. A variety of mechanisms as known to those skilled in the art can be utilized to achieve this regulatory function, such as voltage dividers with non-inverting inputs. In one embodiment, as shown, the third contact 270 is in electrical contact with one of the socket contacts and electrical conductors but disposed inside said plug body to also be insulated electrically from other components.

Contacts 250 and 260, in one embodiment are socket contacts and can be fabricated from conductive metals, preferably copper, and are separated electrically from one another by insulation or use of other non-conductive materials.

A nonconductive support bar 190 is also provided within the plug body 120, as shown in FIG. 2, separating at least portions of the first contact and first electrical conductor from the second contact and the second electrical conductor. A better view of the structure and function of this support bar 190 is provided in the illustrations of FIGS. 1 and 3.

In a preferred embodiment, the nonconductive support bar 190 is a substantially rigid nonconductive element also referred, hereinafter referenced as a stiffener. The stiffener 190 can be fabricated out of a variety of different materials with selective rigidities and characteristics. In addition, in situations when arcing is to be inhibited, the stiffener can include compounds with improved arc resistivity such as polyethylenes, thermosetting plastics, melamine resins, plastics formulated to emit gasses with arc extinguishing properties and others, as known to those skilled in the art.

In a preferred embodiment as depicted in FIGS. 1 and 2, the stiffener 190 is disposed entirely in the plug body 120. However, in alternate embodiments, the stiffener 190 can be partially disposed outside of the plug body 120.

Figure 3:
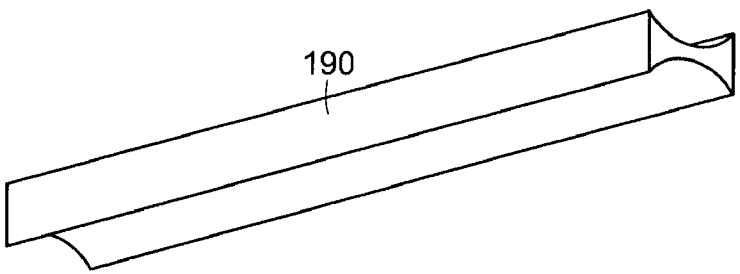
FIG. 3 is a perspective side view illustration of a nonconductive support bar, as per one embodiment of the present invention.

FIG. 3 provides a side view perspective illustration of the stiffener 190. In a preferred embodiment, the stiffener 190 is complementary to the design of both the socket contacts 250 and 260 and electrical conductors 140 and 145. This can be accomplished by selectively designing the stiffener 190 to look accordingly in different areas, in order to achieve complete conformal support. For example, in the figures shown, a first and a second side of the stiffener 190 are shown that will provide conformal support to electrical conductors. In this figure, the first and second sides are shown to be the top and bottom side of the stiffener 190, which are curved to accommodate for the circular geometry of the electrical conductors 140/145. In addition, the end portion of the stiffener, on one side to be disposed proximally to contacts, is further concaved, on top and bottom, to provide a secure fit for contacts 250 and 260. This is to provide both separation and contour support for the contacts 250/260 in order to inhibit misalignment and prevent short circuits. Depending on the geometry of the electrical conductors and the contacts, the structure of the sides of the stiffener (top and bottom sides in the figure) and the end portions may have a different and separate geometry. It is even possible that the (socket) contacts 250 and 260 have a different shape from one another. Similarly, the first and second electrical conductors may have different widths or be configured in different manners. In such cases, each side or end of the stiffener 190 will be designed specifically to conform to the specific geometric requirements of the particular contact or electrical conductor to which support is to be given. In short, geometrical symmetry needs not be maintained in the design of the stiffener 190 as with respect to its sides and/or ends.

Furthermore, the other remaining surfaces (when applicable) of the stiffener 190 can also be selectively formed to accommodate the plug body 120 or other plug components. For example in the preferred embodiment of FIG. 2, the side surfaces of the stiffener 190, is fabricated to be substantially flat and thin so as to be fully enclosable within the plug body sides. This can be viewed better in the illustration of FIG. 1, where the stiffener 190 is (at least) flush with the plug body 120.

The stiffener 190 prevents misalignment of the socket contacts 250 and 260 and the shearing and rupturing of the electrical conductors/cables 140 and 145, especially during engagement and disengagement of the plug 110 from an electrical/electronic outlet or device. This result is achieved by providing an additional layer of insulation and by reducing tensile forces acting upon the plug and/or assembly in all directions and along the "X", "Y" and "Z" axis. For example, in the vertical direction, along the "Y" axis, the stiffener 190 limits the front to back movement of the socket contacts 250 and 260 when the plug 110 is being engaged or disengaged, such as from the aircraft. In its alignment capacity, the stiffener 190 aids both first and second contacts 250/260 such that they remain parallel by keeping the receptacle forces at a constant for example during insertion or engagement of the plug. The stiffener 190 gives stability in the horizontal direction along the "X" axis during its engagement and/or disengagement. Furthermore, the stiffener 190 provides protection rotationally and protects the fine strands of metal, such as copper conductors, from breaking away. Usually, these strands can be easily broken causing the circular mil area of the conductor to become smaller. Since the current remains constant, the damage will subsequently cause overheating which may ultimately cause more damage to the strands and more overheating of the device and the conductors. Eventually, as more and more strands are damaged the metal (copper especially) can completely melt or twists such as to cause the plug to split open entirely.

In a preferred embodiment, the contacts 250 and 260 are socket contacts as discussed. In this embodiment, the use of socket contacts is to allow additional structural support from the plug mating counterpart (not shown) once the plug is engaged. In such a situation, the plug mating counterpart is most likely a receptacle having pins or prongs that are to extend into the sockets during engagement. Consequently, during engagement and once the plug 100 has mated with its complementary receptacle, the prongs/pins of the receptacle extend into the plug on either side of the stiffener 190 to provide additional structural support to the arrangement. In other words, the stiffener gets additional structural support when the plug is engaged into a complementary receptacle due to the fact that pins from that receptacle extend into the plug sockets 250 and 260, on either side of the stiffener 190. In addition to providing structural support, this arrangement also takes the weight of the cable off of the connection (i.e. crimp) in the plug 100.

The assembly of FIGS. 1 through 3 can be fabricated using several methods. In one embodiment, for example, a cable assembly similar to that discussed in conjunction with FIG. 2 can be manufactured having a plug comprising the following steps. First a first and second conductor, such as a power and a ground conductor, are disposed in conductive contact with first and second contact. In this example the contacts will be comprised of a power contact and a ground contact. The non-conductive support bar would be disposed also so as to separate at least portions of the power contact and the power conductor from the ground contact and the ground conductor. A third contact can also be disposed in the plug body and enabled to function as a voltage regulator. The plug body will then be molded to encase the contacts, the support bar and at least the ends of the power and ground conductors.

In alternate embodiments, the fabrication method may be altered. Other changes as discussed may also be provided. For example the ground and power conductors may be substituted by any other combination of phase conductors and associated contacts with opposite charges may be alternatively designated as positive and negative. As before, the nonconductive support bar will be fabricated to be complementary to the shape of the contacts and conductors. In one embodiment, the ground and power conductors may also have insulating sheaths extending within the plug body.

Figure 4:
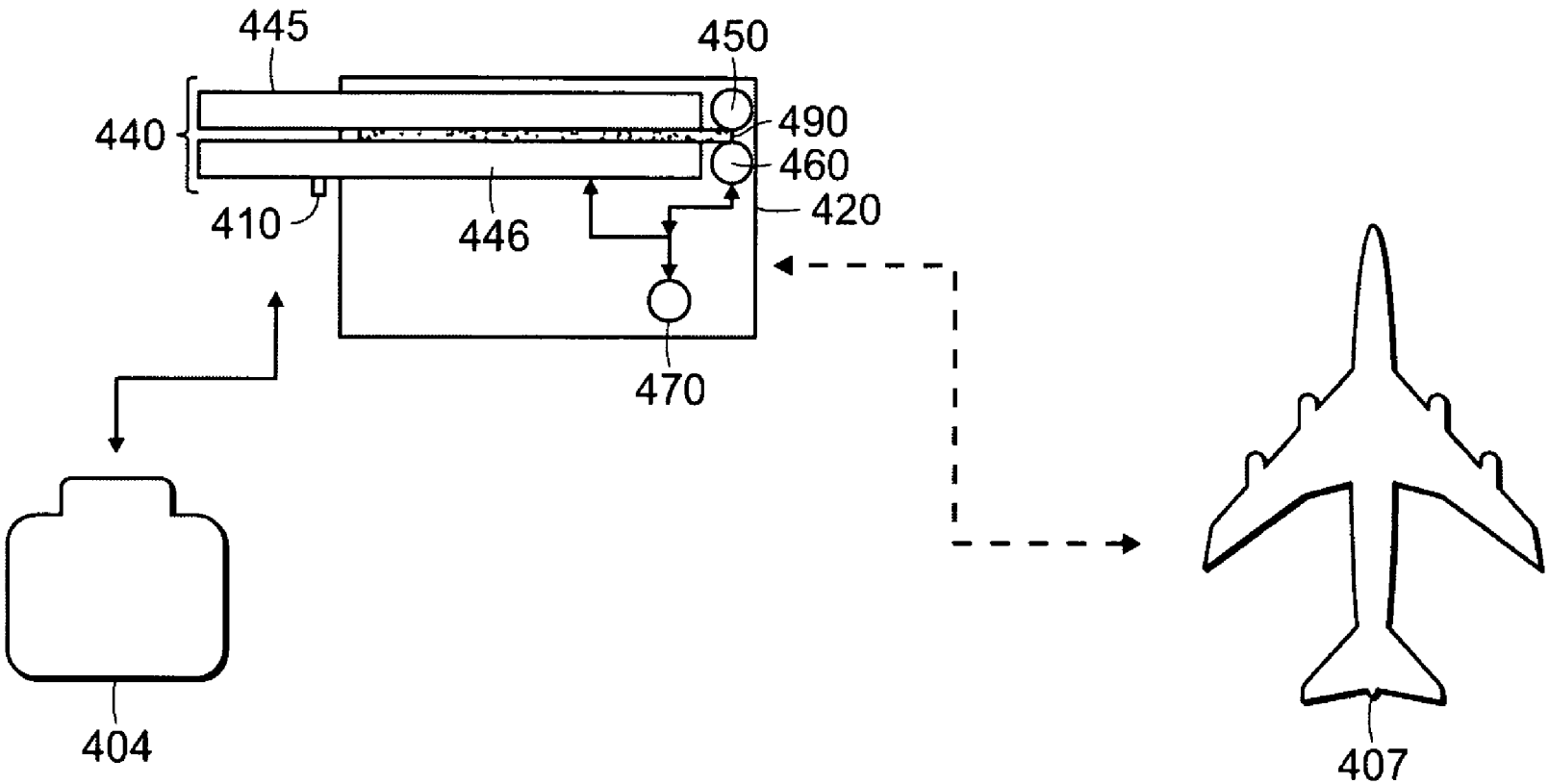
FIG. 4 is a schematic illustration of an aircraft power generation system adapted to provide power to an aircraft, as per one embodiment of the present invention.

FIG. 4 is an illustration of one embodiment of the present invention, where the plug is used specifically powering a stationary airplane. In FIG. 4, an aircraft power generation system 400 is adapted to provide power to a grounded aircraft 402. The system comprises a generator 404 and a cable assembly 440 for transferring power from the generator 404 to the aircraft 402. The cable assembly 440 includes an insulated power conductor 445 and an insulated ground conductor 446 that are attached to a plug 410 for connection to the aircraft 402. The plug 410 further includes a plug body 420 having a nonconductor exterior with a proximal end and a distal end with respect to aircraft 402, with the distal end being remote from the aircraft 402. The plug body 420 also includes a plurality of contacts 450/460. The contacts 450 and 460 can be socket contacts and further designated as having opposite charges such as ground and power in one embodiment. A third 270 is also provided for regulating the input voltage.

A substantially rigid nonconductive element 490 is disposed between the conductors 445 and 446 and the contacts 450 and 460 within the plug body 420. In the embodiment of FIG. 4, the substantially rigid element 490 extends in a direction between the proximal and distal ends and the substantially rigid element 490 is adapted to inhibit shearing and rupturing of the conductors 445 and 446, as well as the misalignment of the contacts 450 and 460.

As before, one of the objectives of including the substantially rigid element 490, may be as long or selectively shorter than the cables and or the plug body. Again the substantially rigid element 490 will be complementary in design with the configurations of the contacts and the cable (as before) and can provide the same geographical flexibilities as previously discussed in conjunction with FIG. 3.

While the invention has been described in accordance with certain preferred embodiments thereof, those skilled in the art will understand the many modifications and enhancements which can be made thereto without departing from the true scope and spirit of the invention, which is limited only by the claims appended below.

What is claimed is:

1. An assembly for transferring electrical power, comprising:

a first and second insulated electrical cables;

a plug body attached to ends of said cables a first contact and a second contact within said plug body, having electrically conductive connections with said first and second cables;

a rigid non conductive support bar disposed at least partially within said plug body separating at least portions of said first contact and said first cable from said second contact and said second cable; said support bar being disposed such as to extend in a lengthwise direction of said cables and being resistant to applied forces so as to protect said cables from shearing while said plug body is engaged during engagement and disengagement.

2. The assembly of claim 1, wherein said plug body is molded at least to ends of said cables.

3. The assembly of claim 1, wherein said plug body has a proximal end and a distal end with respect to engagement with one or more electrical/electronic outlets and/or devices, and said contacts are disposed in said proximal end.

4. The assembly of claim 3, wherein said nonconductive support bar is formed conformal to contours of said contacts so as to provide support and insulation as to also inhibit contact misalignment and prevent electrical short circuits.

5. The assembly of claim 3, wherein said non-conductive support bar is formed conformal to contours of said conductors so as inhibit rupturing of said cables and rupturing and shearing of said plug during engagement and disengagement of the assembly.

6. The assembly of claim 3, wherein said nonconductive support bar is disposed between said proximal end and extending toward said distal end such that said nonconductive support bar is disposed entirely within said plug body.

7. The assembly of claim 1, wherein said plug assembly further comprises a third electrical contact element disposed substantially at said proximal end.

8. The assembly of claim 7, wherein said third contact includes a regulatory mechanism for maintaining voltage input and said contacts are made essentially from copper.

9. The assembly of claim 1, wherein said first and second contacts are power and ground contacts and said first and second conductors are power and ground conductors.

10. The assembly of claim 1, wherein said nonconductive support bar is a stiffener of adequate rigidity such as to limit vertical front to back movement exerted due to tensile forces during engagement and disengagement of the assembly.

11. The assembly of claim 1, wherein said nonconductive support bar is a stiffener of adequate rigidity such as to limit movement in a horizontal direction during engagement and disengagement of the assembly.

12. The assembly of claim 1, wherein said nonconductive support bar is a stiffener of adequate rigidity such as to limit movement in an "X", "Y" and "Z" direction due to its strength or by exerting opposing reaction to said acting tensile forces during engagement and disengagement of the assembly.

13. The assembly of claim 1, wherein said contacts are socket contacts enabled to receive pins from a complementary mating receptacle during engagement, such that after engagement said pins extend into said socket contacts on either side of said stiffener to provide additional structural rigidity.

14. The assembly of claim 1, wherein said electrical cables are attachable to said plug and/or contacts through one or more attachment components.

15. An aircraft power generation system adapted to provide power to a grounded aircraft, said system comprising:

a generator:

a cable assembly for transferring power from the generator to the aircraft, the cable assembly including an insulated power cable and an insulated ground conductor attached to a plug for connection to the aircraft, the plug including: a plug body having a nonconductor exterior with a proximal end proximate said aircraft and a distal end remote therefrom, a power contact and a ground contact within said plug body; and a substantially rigid nonconductive element disposed lengthwise between and in direction of said insulated power cable and said conductors and said contacts within said plug body, said substantially rigid element extending in a direction between the proximal and distal ends, said substantially rigid element adapted to inhibit misalignment of said contacts and shearing and rupturing of said cable assembly.

16. The system of claim 15, wherein said plug body further comprises a third contact having a regulatory mechanism for maintaining voltage input.

17. A method of fabricating a cable assembly having a plug, comprising: disposing a first conductor and a second conductor in conductive contact with a first contact and a second contact with a non-conductive support bar separating at least portions of said first contact and said first conductor from said second contact and said second conductor; and molding a plug body to encase said contacts, said support bar and at least ends of said power and ground conductors; said support bar being disposed lengthwise between said first and second conductor and in direction of said conductors and being of adequate rigidity such as to prevent shearing of conductors during engagement and disengagement and during frequent use due to tensile and other forces.

18. A method as claimed in claim 17, wherein said first and second conductors are ground and power conductors and said nonconductive support bar is shaped to support conformal geometry of said conductors and said contacts.

19. A method as claimed in claim 17, wherein said ground and power conductors have insulating sheaths extending within said plug body.

20. The method of claim 17, further comprising the step of disposing, within said plug body, a third contact having a regulatory mechanism for maintaining voltage input.

* * * * *